US008973856B2

(12) United States Patent
Croyle

(10) Patent No.: US 8,973,856 B2
(45) Date of Patent: Mar. 10, 2015

(54) HANDLING APPARATUS AND METHODS FOR HANDLING A ROLLER OF A ROLLER CRUSHER

(75) Inventor: Robert C. Croyle, Shippenville, PA (US)

(73) Assignee: Metso Minerals Industries, Inc., Waukesha, WI (US)

( * ) Notice: Subject to any disclaimer, the term of this patent is extended or adjusted under 35 U.S.C. 154(b) by 123 days.

(21) Appl. No.: 13/469,169

(22) Filed: May 11, 2012

(65) Prior Publication Data

US 2013/0298373 A1 Nov. 14, 2013

(51) Int. Cl.
*B02C 4/32* (2006.01)

(52) U.S. Cl.
USPC ..... 241/285.2; 72/238; 414/745.1

(58) Field of Classification Search
CPC ..... B02C 4/32
USPC ..... 241/285.2, 285.3; 72/237–239; 414/745.1; 29/426.3, 428
See application file for complete search history.

(56) References Cited

U.S. PATENT DOCUMENTS

| | | | | |
|---|---|---|---|---|
| 2,539,775 | A * | 1/1951 | Gordon | 241/188.2 |
| 3,208,678 | A | 9/1965 | Pick et al. | |
| 3,881,663 | A * | 5/1975 | Brown | 241/225 |
| 3,970,256 | A | 7/1976 | Ruegger et al. | |
| 4,630,781 | A * | 12/1986 | Brown et al. | 241/159 |
| 4,632,655 | A * | 12/1986 | Benkwitz | 425/186 |
| 5,323,976 | A | 6/1994 | Johnson et al. | |
| 5,580,009 | A | 12/1996 | Kennedy | |
| 5,911,373 | A | 6/1999 | Reid | |
| 8,096,745 | B2 | 1/2012 | Lamothe | |
| 2011/0097026 | A1 | 4/2011 | Niklewski et al. | |

OTHER PUBLICATIONS

PCT Search Report and Written Opinion dated Jun. 19, 2013.
Australian Examination Report for Patent Application No. 2013202279, dated Jun. 30, 2014.

* cited by examiner

*Primary Examiner* — Mark Rosenbaum
(74) *Attorney, Agent, or Firm* — Andrus Intellectual Property Law, LLP

(57) ABSTRACT

The invention relates to a handling apparatus for handling a roller of a roller crusher. The handling apparatus comprises a movable base, a carrier pivotably attached to said base and adapted to carry the roller, at least one carrier pivoting device pivotably attached to said base and attached to said carrier, said carrier pivoting device being extendable, and at least one roller pivoting device pivotably connected to said base, said roller pivoting device being adapted to releasably engage said roller. The invention also relates to a method for mounting a roller to a roller crusher and a method for dismounting a roller to a roller crusher.

12 Claims, 6 Drawing Sheets

HANDLING APPARATUS AND METHODS FOR HANDLING A ROLLER OF A ROLLER CRUSHER

TECHNICAL FIELD

The present disclosure relates to a handling apparatus for handling a roller of a roller crusher. Further, the present disclosure relates to a method for mounting a roller to a roller crusher and a method for dismounting a roller from a roller crusher.

BACKGROUND ART

When crushing or grinding rock, ore, cement clinker and other hard materials, roller crushers may be used having two generally parallel rolls which rotate in opposite directions, towards each other, and which are separated by a gap. The material to be crushed is fed by gravity or choke-fed into the gap. One type of roller crusher is called high pressure grinding rollers or high pressure roller crushers. This type of roller crusher uses a crushing technique called interparticle crushing. Here, the material to be crushed or pulverised is crushed, not only by the crushing surface of the rolls, but also by particles in the material to be crushed, hence the name interparticle crushing. One example of a high pressure grinding roller is described in EP-516 952.

The rollers of the roller crusher is exposed to a very high pressure and accordingly for extreme wear from the material to be crushed. When the roller surface is worn to a certain extent, the roller must be dismounted to be reconditioned or replaced. This dismounting operation is difficult to execute at the installation place of the equipment, in most cases requiring the whole assembly formed by the shaft, crushing shell, end bearings and respective bearing housings to be removed from the equipment and transported to a place in which the reconditioning or replacement of the crushing surface and, eventually, of the bearings, can be adequately and safely carried out. The subsequent mounting is equally complicated.

Taking into account that the assembly defined by each of the rollers and respective bearings and bearing housings represents a large weight, corresponding to a preponderant part of the weight of the equipment as a whole, the operations of dismounting, carrying and remounting the roller assemblies require special cares, which are complex, time-consuming and, consequently, expensive.

SUMMARY

The present disclosure provides a handling apparatus which allows a simple, fast and safe mounting and dismounting of a roller to and from a roller crusher. Further, it is a feature of the present disclosure to provide a method for mounting a roller to a roller crusher and a method for dismounting a roller from a roller crusher.

These and other features and advantages that will be apparent from the following description of the present disclosure are achieved by a handling apparatus for a grinding roll for heavy wear operation according to the following features.

Thus, a handling apparatus for handling a roller of a roller crusher is provided. The handling apparatus comprises a movable base, a carrier pivotably attached to said base and adapted to carry a roller, at least one carrier pivoting device pivotably attached to said base and attached to said carrier, said carrier pivoting device being extendable, and at least one roller pivoting device pivotably connected to said base, said roller pivoting device being adapted to releasably engage said roller. This is advantageous in that the roller can be dismounted from and later on mounted back onto the roller crusher in a safe and simple manner. The handling apparatus makes the handling of rollers automatic and time efficient, and consequently cost efficient. The handling apparatus can be used both for dismounting and mounting of rollers, but also for transport of rollers away from the roller crusher for replacement or conditioning and back to the roller crusher for subsequent mounting. During use, the handling apparatus is transported to the roller crusher and placed parallel to the roller to be dismounted. The carrier is then arranged in connection with the roller crusher by means of the carrier pivoting device such that the roller pivoting device can engage the roller and guide it onto the handling device in two steps. Thereafter, the roller can be transported away from the roller crusher for replacement or conditioning. The opposite procedure is implemented in order to mount the roller back onto the roller crusher.

The roller pivoting device may be extendable, which makes it more flexible in relation to the roller to be mounted or dismounted.

The carrier may comprise a support member adapted to rest against said base for support. The support member will increase the stability of the handling device, especially when it carries a roller.

The carrier may have a shape conforming to an outer shape of a bearing housing, which shape may be a triangular shape. The carrier will thus be adapted to receive a bearing housing having a triangular shape, which is a preferred embodiment.

The carrier may have power drive in order to rotate over its pivot point, which is advantageous in that the carrier will be more flexible in relation to the base.

The carrier may be adjustable to be able to accept different types of rollers or bearing housings. Naturally, this will make the carrier suitable for all types of rollers and bearing housings.

The base may be adapted to be lifted by a lifting machine and may comprise power drive in order to move along a ground, which makes the handling apparatus movable to a greater extent.

The carrier pivoting device may pivotably attached to said carrier in order to increase the movability of the apparatus.

The roller pivoting device may be pivotably attached to said carrier. When the roller pivoting device is attached directly to the carrier, it will be positioned in relation to the roller by means of the movement of the carrier, thereby simplifying the operation.

The roller pivoting device may be adapted to releasably engage a bearing housing of said roller. In some roller crushers, the roller is held by a bearing housing which naturally can be dismounted together with the roller by means of the handling apparatus. Here, the roller pivoting device engages the bearing housing holding the roller instead of the roller itself directly.

According to a second aspect of the disclosure, a method for mounting a roller to a roller crusher is provided. The method comprises transporting a base having a carrier carrying the roller to said roller crusher, pivoting said carrier a first angle towards said roller crusher, pivotably attaching said roller to a first attachment point of said roller crusher, pivoting said roller a second angle towards said roller crusher, and attaching said roller to a second attachment point of said roller crusher.

According to a third aspect of the disclosure, a method for dismounting a roller to a roller crusher is provided. The method comprises detaching said roller from a second attachment point of said roller crusher, pivoting said roller a second angle away from said roller crusher, detaching said roller from a first attachment point of said roller crusher, pivoting a carrier carrying the roller a first angle away from said roller crusher onto a base, transporting said base away from said roller crusher.

The methods are advantageous in that the roller can be dismounted from and later on mounted back onto the roller crusher in a safe and simple manner. The handling of rollers is made time efficient, and consequently cost efficient.

Generally, all terms used in the following are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise. The steps of any method disclosed herein do not have to be performed in the exact order disclosed, unless explicitly stated.

As used herein, the term "comprising" and variations of that term are not intended to exclude other additives, components, integers or steps.

BRIEF DESCRIPTION OF THE DRAWINGS

The above, as well as additional objects, features and advantages of the present disclosure, will be better understood through the following illustrative and non-limiting detailed description of preferred embodiments of the present invention, with reference to the appended drawings, where the same reference numerals will be used for similar elements, wherein.

DETAILED DESCRIPTION OF PREFERRED EMBODIMENTS OF THE INVENTION

Figure 1:
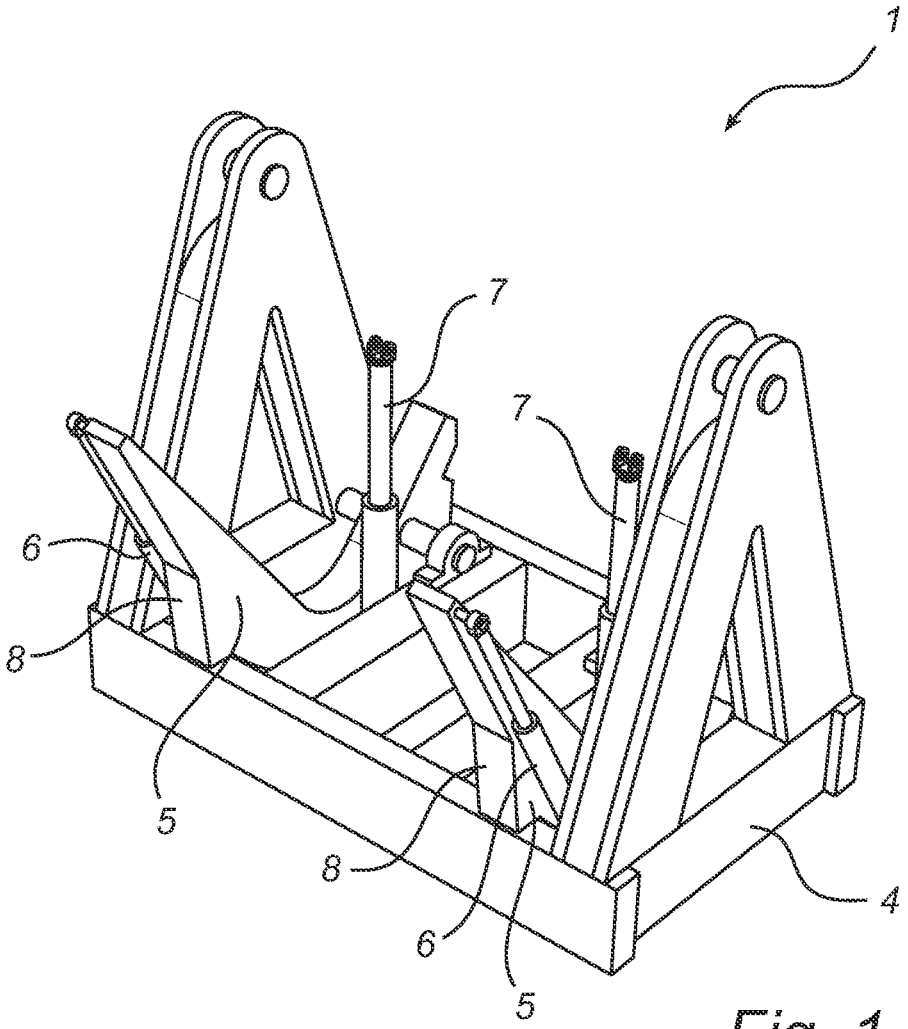
FIG. 1 is a perspective view of a handling apparatus according to one exemplary embodiment of the present invention.

FIG. 1 illustrates a handling apparatus 1 for handling a roller 2 of a roller crusher 3 according to one exemplary embodiment of the present invention. The handling apparatus 1 comprises a movable base 4, a carrier 5, two carrier pivoting devices 6 and two roller pivoting devices 7. The carrier 5 is pivotably attached to the base 4 and adapted to carry a roller 2. The carrier 5 comprises a support member 8 which is adapted to rest against said base 4 for support. The support member 8 thereby increases the stability of the handling device 1 when it carries a roller 2. The carrier 5 has a triangular shape which conforms to an outer shape of a chosen part of the roller crusher 3, in this case a bearing housing 9. The carrier 5 will thus be adapted to receive a bearing housing 9 having a triangular shape. Each one of the two carrier pivoting devices 6 is pivotably attached to the base 4 and to the carrier 5, respectively. The carrier pivoting devices 6 are extendable in their longitudinal direction. Each one of the roller pivoting devices 7 are connected to the base 4 by being pivotably attached to the carrier 5. As an option, the roller pivoting devices 7 can be pivotably attached directly to the base 4. The roller pivoting devices 7 are extendable in their longitudinal direction and adapted to releasably engage said roller 2 via a bearing housing 9 holding the roller 2.

Figure 2A:
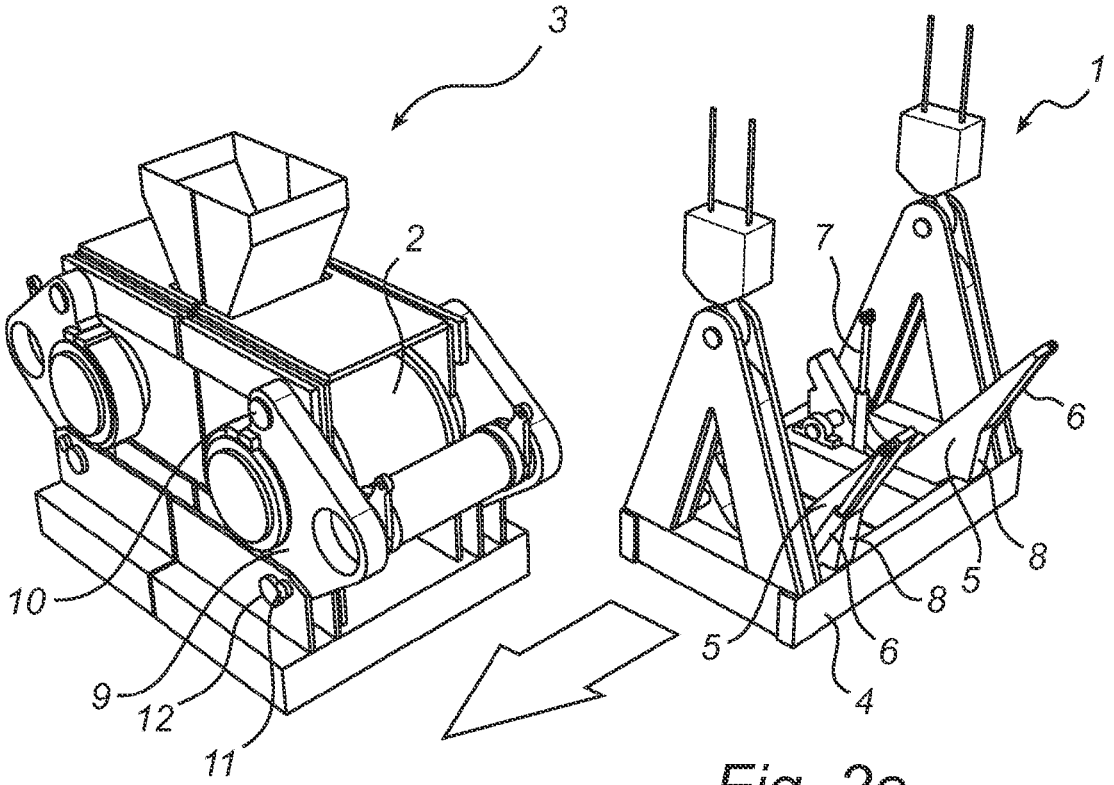
FIGS. 2*a*-2*i* are sequence views which illustrate the dismounting of a roller from a roller crusher by means of the handling apparatus.

In FIG. 2*a*, the handling apparatus 1 is illustrated when being transported to the roller crusher 3 for dismounting of the roller 2 of the roller crusher 3.

Figure 2B:
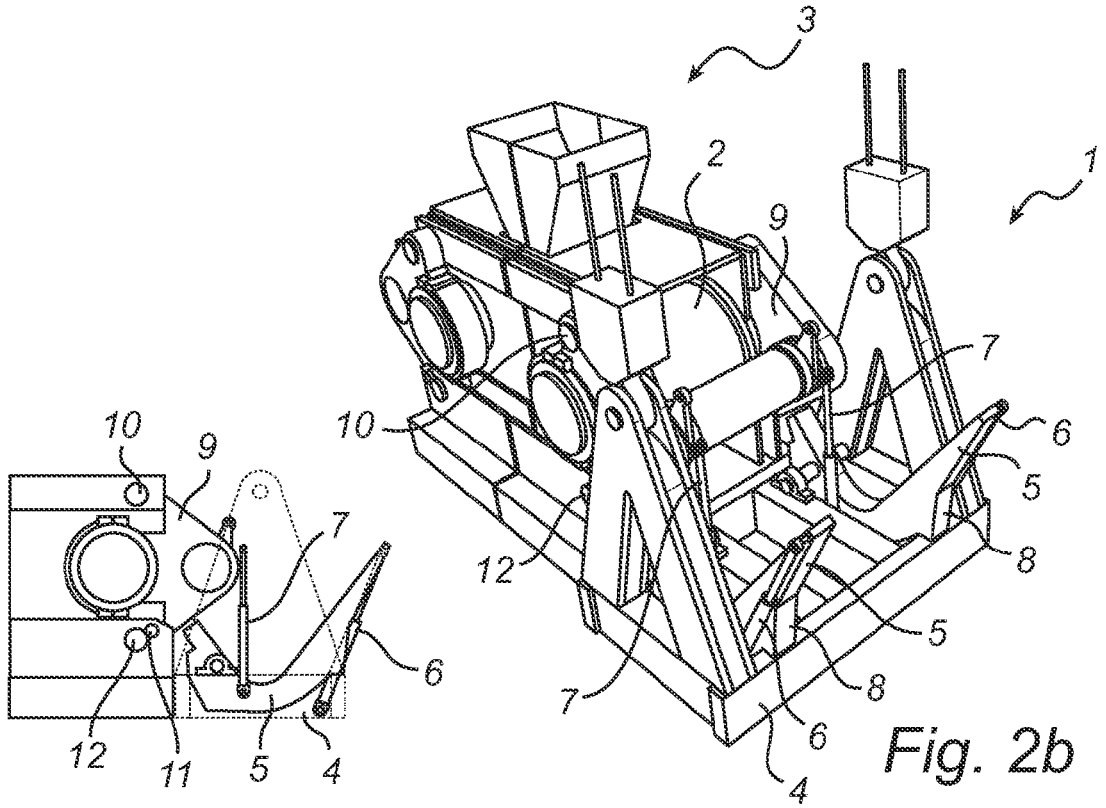

FIG. 2*b* illustrates the handling apparatus 1 when being lined up to bearing housing 9 holding the roller 2 to be dismounted.

Figure 2C:
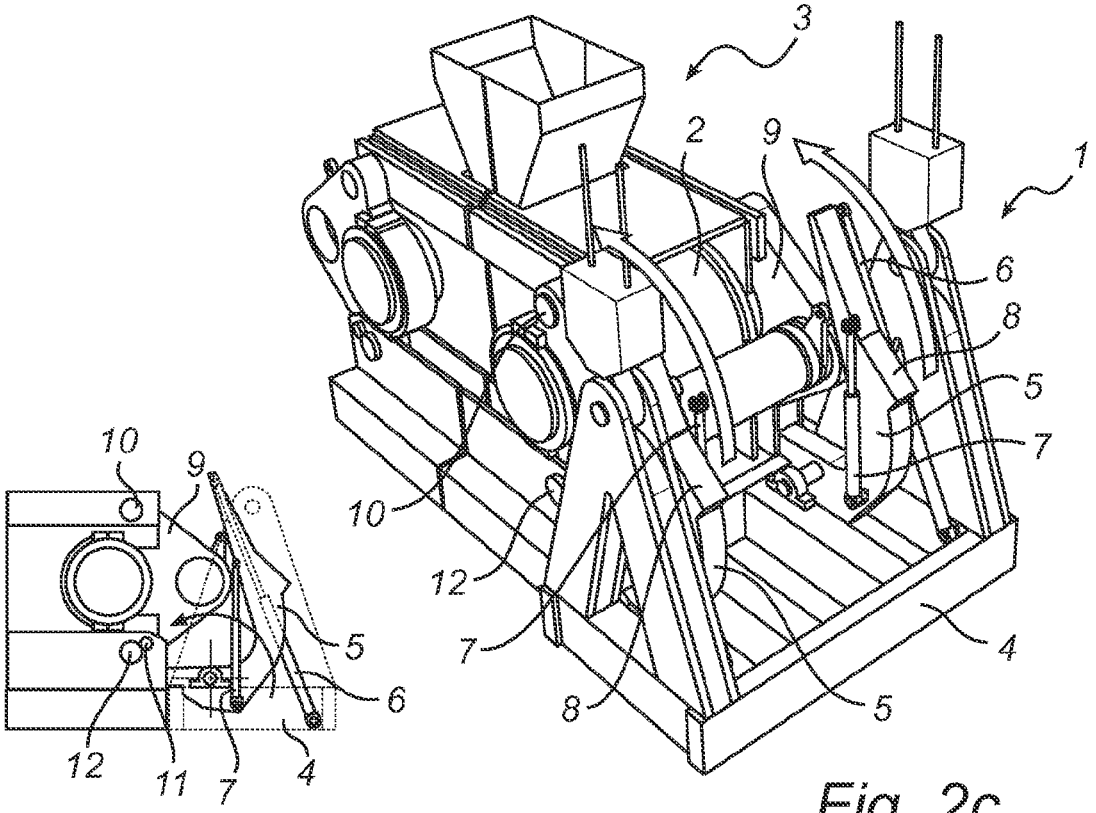

In FIG. 2*c*, the carrier 5 of the handling apparatus 1 is pivoted towards the bearing housing 9 holding the roller 2 to be dismounted by means of the two carrier pivoting devices 6. The carrier pivoting devices 6 are pivoted in relation to the base 4 and extended in their longitudinal direction.

Figure 2D:
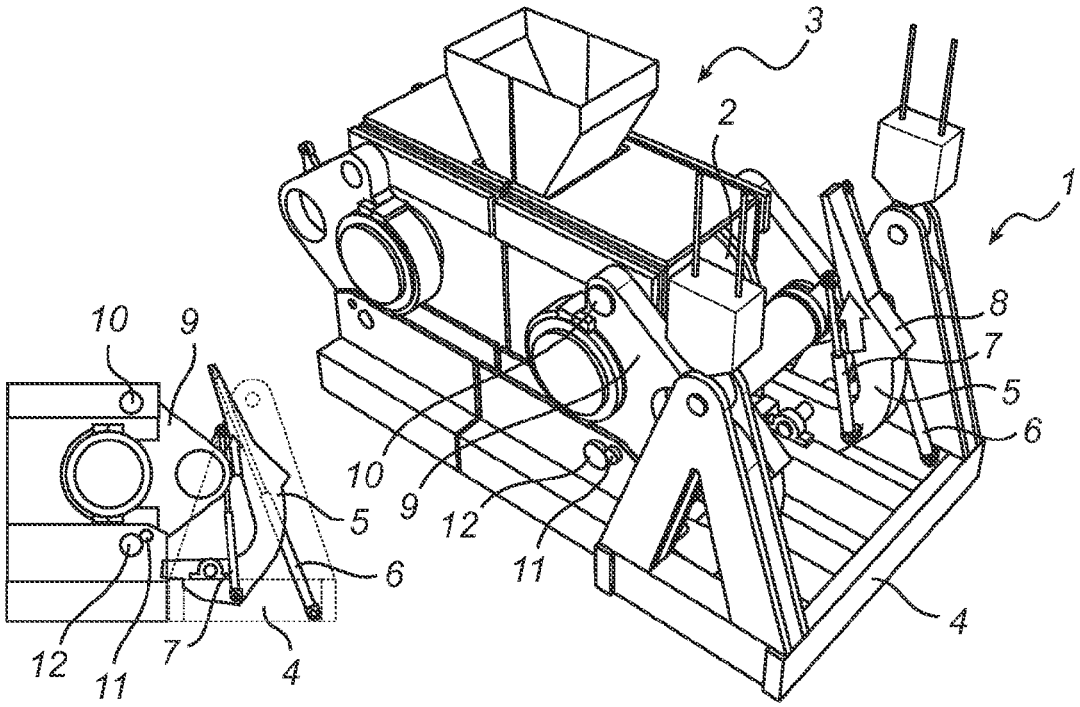

FIG. 2*d* illustrates how the two roller pivoting devices 7 engage with the bearing housing 9 holding the roller 2 to be dismounted by being pivoted in relation to the carrier 5.

Figure 2E:
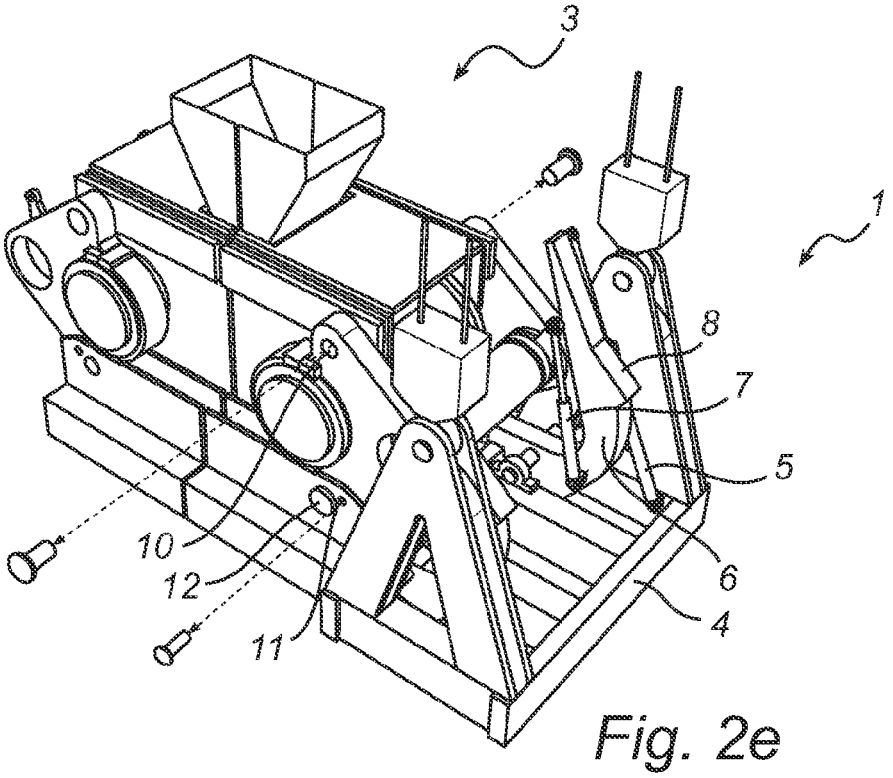

In FIG. 2*e*, the bearing housing 9 holding the roller 2 to be dismounted is detached from a second attachment point 10 on each side of the roller crusher 3. Additionally, the bearing housing 9 is detached from a fixation point 11 on each side of the roller crusher 3.

Figure 2F:
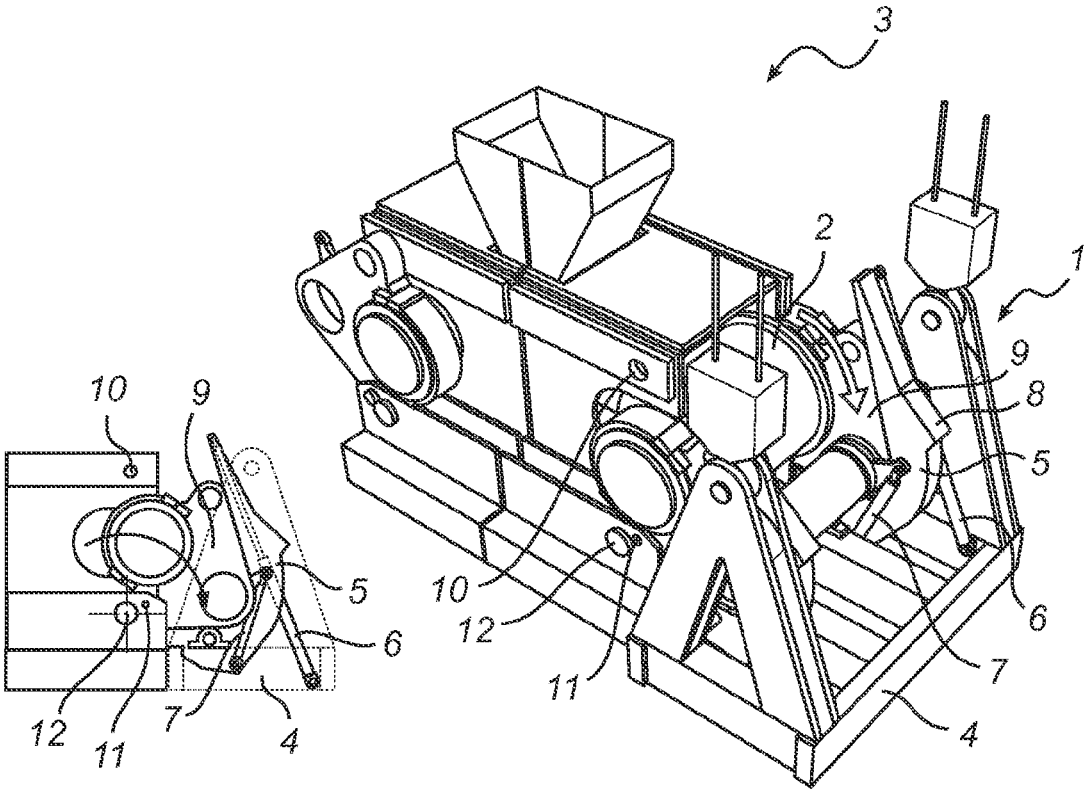

FIG. 2*f* illustrates how the bearing housing 9 holding the roller 2 to be dismounted is pivoted a second angle away from the roller crusher 3. The bearing housing 9 is pivoted by means of the roller pivoting devices 7 which are retracted in their longitudinal direction and pivoted in relation to the carrier 5.

Figure 2G:
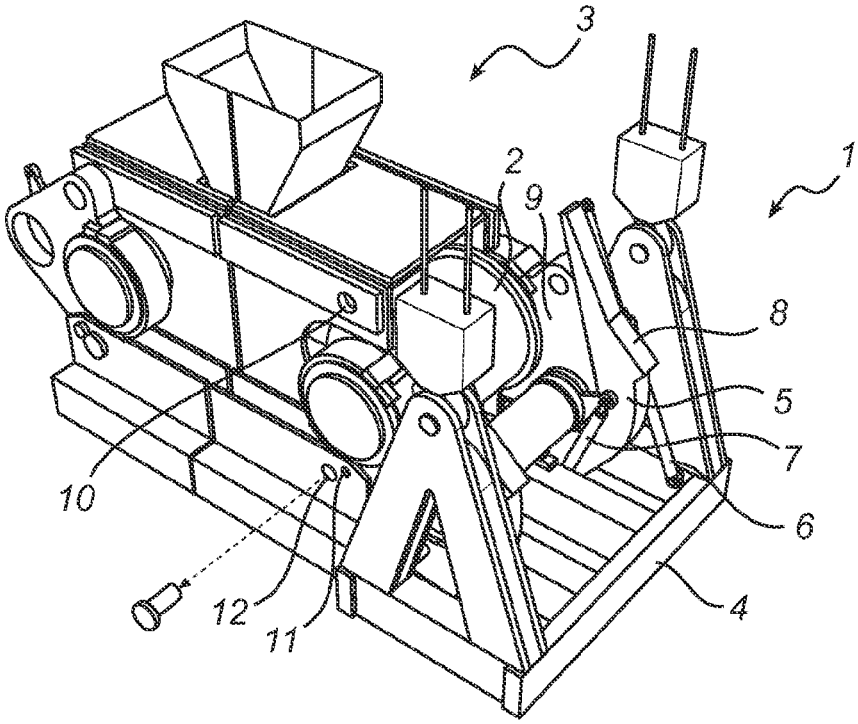

In FIG. 2*g*, the bearing housing 9 holding the roller 2 to be dismounted is detached from a first attachment point 12 on each side of the roller crusher 3.

Figure 2H:
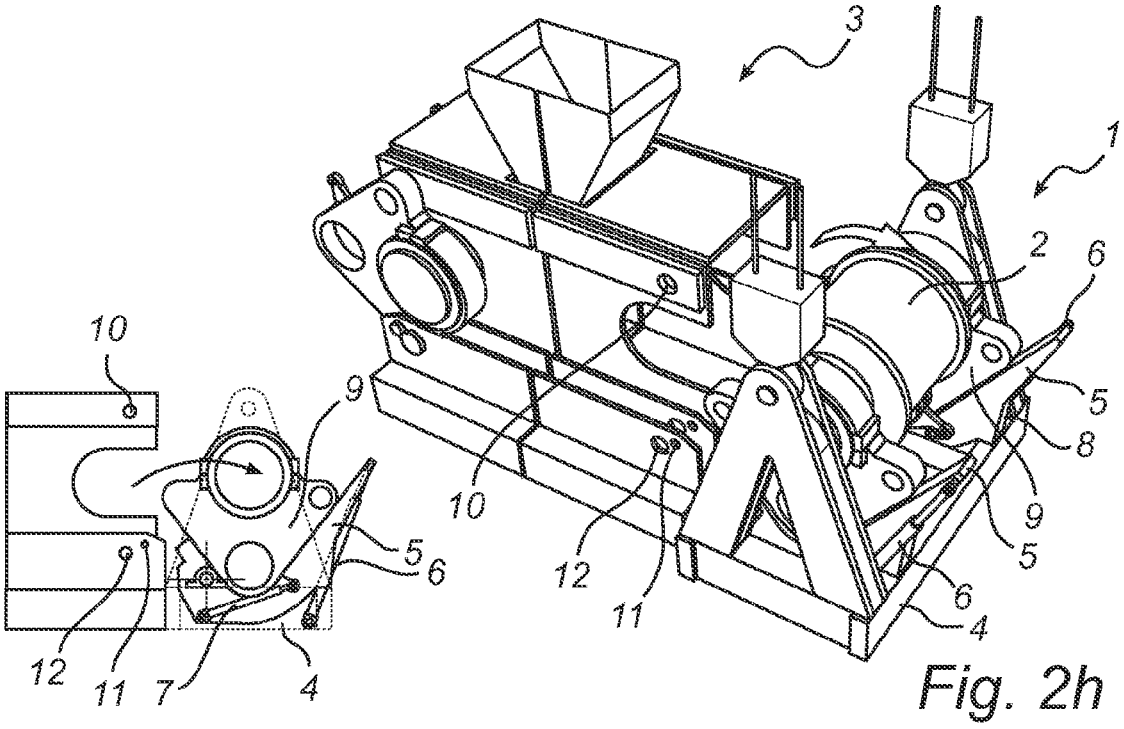
Figure 2I:
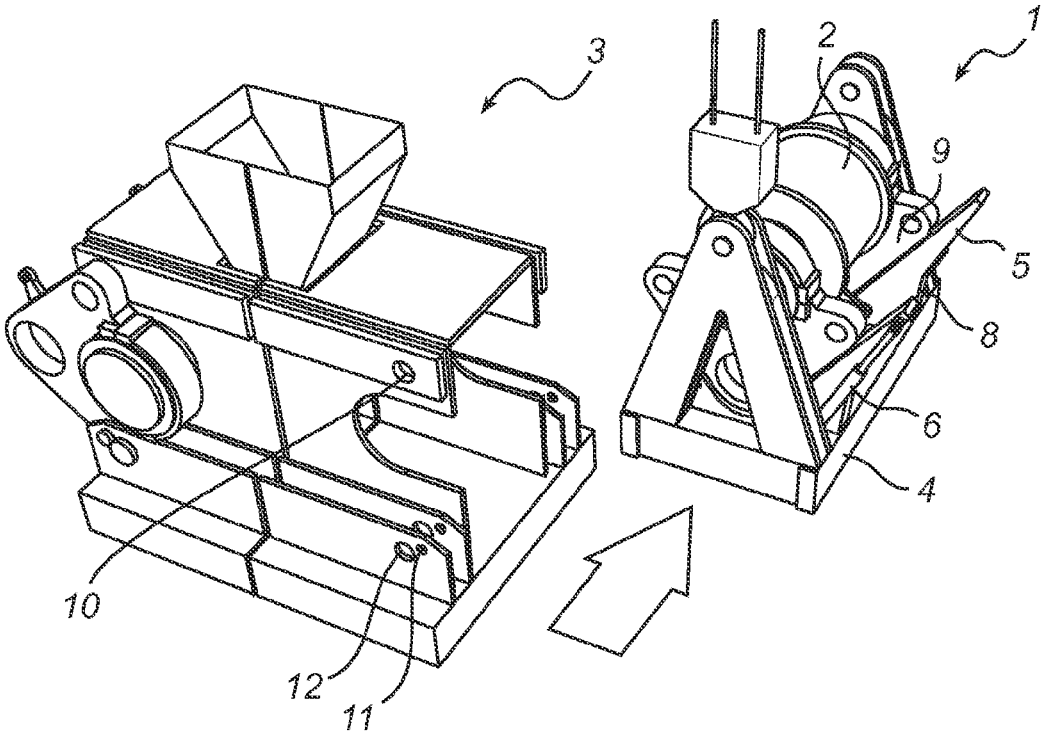

FIG. 2*h* illustrates how the bearing housing 9 holding the roller 2 to be dismounted is pivoted a first angle away from the roller crusher 3. The bearing housing 9 is pivoted by means of the carrier pivoting device 6 which are retracted in their longitudinal direction and pivoted in relation to the base 4. The bearing housing 9 is thus arranged in the handling apparatus 1 and can together with the roller 2 be transported away from the roller crusher 3 as illustrated in FIG. 2*i*.

According to a second aspect of the invention, a method for mounting a roller to a roller crusher is provided. The method comprises transporting a base having a carrier carrying the roller to the roller crusher, pivoting the carrier a first angle towards the roller crusher, pivotably attaching the roller to a first attachment point of the roller crusher, pivoting the roller a second angle towards the roller crusher, and attaching the roller to a second attachment point of the roller crusher.

According to a third aspect of the invention, a method for dismounting a roller to a roller crusher is provided. The method comprises detaching the roller from a second attachment point of the roller crusher, pivoting the roller a second angle away from the roller crusher, detaching the roller from a first attachment point of the roller crusher, pivoting a carrier carrying the roller a first angle away from the roller crusher onto a base, transporting the base away from the roller crusher.

The handling apparatus 1 can, for example, run on a fixed track, such as a rail, for transport to and from the roller crusher 3. According to a preferred embodiment of the invention, two handling apparatuses 1 are associated with each roller crusher 3, one on each side of the same. This way, one handling apparatus 1 will be available for each one of the rollers 2.

The invention has mainly been described above with reference to a few embodiments. However, as is readily appreciated by a person skilled in the art, other embodiments than the ones disclosed above are equally possible within the scope of the invention, as defined by below.

The size, shape and number of the carrier pivoting device and roller pivoting device of the handling apparatus can naturally be varied to any suitable extent. The handling device can be used both for mounting a roller to a roller crusher and dismounting a roller to a roller crusher, either directly or together with, for example, a bearing housing holding the roller.

The carrier can comprise mechanical locking devices in order to fix the bearing housing to the handling apparatus for increased safety during transportation. Also, the carrier can comprise one or several positioning devices in order to facilitate the mounting of a roller to the roller crusher.

The base can comprise a locking device in order to fix the handling apparatus to the ground during the mounting and dismounting operation.

The invention claimed is:

1. A handling, apparatus for handling a roller of a roller crusher, comprising:

a movable base;

a carrier pivotably attached to said base and adapted to carry the roller;

at least one carrier pivoting device pivotably attached to said base and attached to said carrier, said at least one carrier pivoting device being extendable to pivot the carrier relative to the base; and at least one roller pivoting device pivotably connected to said base, said at least one roller pivoting device being adapted to releasably engage said roller, wherein the at least one roller pivoting device being actuated to move the roller relative to the carrier.

2. A handling apparatus according to claim 1, wherein said at least one roller pivoting device is extendable.

3. A handling apparatus according to claim 1, wherein said carrier comprises a support member adapted to rest against said base for support.

4. A handling apparatus according to claim 1, wherein said carrier has a shape conforming to an outer shape of a bearing housing.

5. A handling apparatus according to claim 4, wherein said shape is a triangular shape.

6. A handling apparatus according to claim 1, wherein said carrier has power drive in order to rotate over its pivot point.

7. A handling apparatus according to claim 1, wherein said carrier is adjustable to be able to accept different types of rollers or bearing housings.

8. A handling apparatus according to claim 1,wherein said base is adapted to be lifted by a lifting machine.

9. A handling apparatus according to claim 1, wherein said base has power drive in order to move along a ground.

10. A handling apparatus according, to claim 1, wherein said at least one carrier pivoting device is pivotably attached to said carrier.

11. A handling apparatus according to claim 1, wherein said at least one roller pivoting device is pivotably attached to said carrier.

12. A handling apparatus according to claim 1, wherein said at least one roller pivoting device is adapted to releasably engage a bearing housing of said roller.

* * * * *